United States Patent [19]

Hoffman

[11] 4,352,700

[45] Oct. 5, 1982

[54] CURE RATE INHIBITORS FOR FERROCENE-CONTAINING PROPELLANTS

[75] Inventor: Richard E. Hoffman, Sandy, Utah

[73] Assignee: The United States of America as represented by the Secretary of the Army, Washington, D.C.

[21] Appl. No.: 218,400

[22] Filed: Dec. 19, 1980

[51] Int. Cl.[3] ..... C06B 45/10

[52] U.S. Cl. ..... 149/19.2; 149/19.4; 149/19.9

[58] Field of Search ..... 149/19.2, 19.4, 19.9

[56] References Cited

U.S. PATENT DOCUMENTS

| | | | |
|---|---|---|---|
| 3,953,257 | 4/1976 | Ayers et al. | 149/7 |
| 3,953,260 | 4/1976 | Braun et al. | 149/19.4 |
| 3,954,529 | 5/1976 | Reed et al. | 149/19.9 |
| 3,974,004 | 8/1976 | Cucksee et al. | 149/19.9 |
| 4,019,933 | 4/1977 | Cuksee et al. | 149/19.4 |
| 4,108,696 | 8/1978 | Ashmore et al. | 149/19.2 |
| 4,181,545 | 1/1980 | Anderson | 149/19.9 |
| 4,260,437 | 4/1981 | Nakagawa et al. | 149/19.9 |

*Primary Examiner*—Edward A. Miller

*Attorney, Agent, or Firm*—Nathan Edelberg; Robert P. Gibson; Jack W. Voigt

[57] ABSTRACT

Disclosed is a phosphate acid diester that is employed in trace amounts in propellants containing ferrocene or ferrocene derivatives wherein it functions as a cure-rate inhibitor. The trace amount of phosphate acid diester extends the pot life of these propellants without inhibiting the final cure thereof.

4 Claims, 6 Drawing Figures

CURE RATE INHIBITORS FOR FERROCENE-CONTAINING PROPELLANTS

DEDICATORY CLAUSE

The invention described herein was made in the course of or under a contract or subcontract thereunder with the Government; therefore, the invention described herein may be manufactured, used, and licensed by or for the Government for governmental purposes without the payment of any royalties thereon.

BACKGROUND OF THE INVENTION

The problems associated with propellant pot life (which is defined hereinbelow) have increased in severity with the increased use of very fine ammonium perchlorate (less than 20 micrometers), and particularly, when ultra fine ammonium perchlorate (UFAP) (particle size generally from about 0.25 to about 5 micrometers) is used in the propellant formulation.

The use of burning rate catalysts, the use of energetic plasticizer compounds, and the use of small particle size oxidizer have been combinations employed to achieve the increased burning rates desired. These combinations attributed to decreased pot life. Pot life is the time during which the propellant mix retains its proper fluid properties to permit mixing and casting.

The definition of pot life teaches that without the proper time and fluid properties sufficient to permit mixing and casting, a propellant batch would be unusable.

Some viscosity control has been effected by use of lecithin; however, lecithin is a processing aid which is effective for effecting smaller changes in fluidity, providing aid in obtaining homogeneity of the propellant mix, and providing some improvement to pot life.

The use of coated ultrafine ammonium perchlorate offers an improvement which effects pot life. For example, U.S. Pat. No. 3,953,257, titled: "Method for Preparing Small Particle Size Coated Ammonium Perchlorate" and assigned to USA as represented by the Secretary of The Army, Washington, D.C., teaches a method for preparing aziridine coated ammonium perchlorate (AP) of weight median diameters (WMD) ranging from about 0.25 to about 5.0 micrometers. The coated AP product extends the pot life for hydroxy terminated polybutadiene (HTPB) propellant formulations.

U.S. Pat. No. 4,019,933, titled: "Pot Life Extension of Isocyanate Cured Propellants by Aziridine Compounds" and assigned to USA as represented by the Secretary of The Army, Washington, D.C., discloses and teaches the use of the reaction product formed from tri-aziridinylphosphine oxides or derivatives thereof reacted with monofunctional carboxylic acids. The reaction product is used to coat AP of less than 20 micrometers particle size which when employed in a propellant composition extend the pot life of the composition.

Shortened pot life has been attributed to the presence of ferric ions that have been released from ferrocene burning rate catalysts and derivatives of ferrocene. The iron content of ferrocene compounds such as n-butyl ferrocene, and the ferrocene derivatives sold as Hycat 6 and Catocene have made them attractive as burning rate catalysts. The ferrocene type catalysts have been tailored to offer various improvements to the propellant system. This tailoring accounts for the changes which are intended to overcome hazards associated with mixing ammonium perchlorate and volatile ferrocene compound, the tendency to migrate in a propellant composition, and the tendency to oxidize. Although certain undesirable features are overcome by the modified compounds, other features may develop or result from interactions between the propellant ingredients which produces other undesirable features. The change in pot life is an undesirable feature which has to be overcome, otherwise, the valuable benefits obtained by the tailoring cannot be put into use if the propellant cannot be processed properly.

An object of this invention is to provide an additive for solid propellant compositions for overcoming the shortened pot life resulting from employing certain ferrocene derivatives as the burning rate catalysts.

Another object of this invention is to provide an additive for solid propellant compositions which functions as a cure-rate inhibitor for ferrocene-containing propellants thereby extending the pot life for these propellants without inhibiting the final cure thereof.

SUMMARY OF THE INVENTION

Trace amounts of a phosphate acid ester (diester) when added to ferrocene-containing propellants function as a cure-rate inhibitor thereby extending the pot life for these propellants without inhibiting the final cure thereof.

The phosphate acid diester of this invention is based on ethoxylated alkylphenols with a structure representing same as follows:

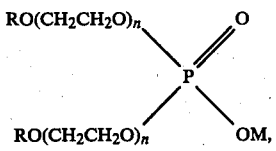

wherein R equals alkyl or alkylaryl, M equals H, alkali metal (e.g. Na, K,) and n equals the average number of moles ethylene oxide reacted with one mole hydrophobe to increase the water solubility of the phosphate acid diester. The equivalent weight of an average batch of a suitable phosphate acid diester and sold commercially by GAF Corporation as GAFAC RM-410 is about 430. A satisfactory value for n of the compound is in the range from about 1 to about 10 when R and M are as defined hereinabove. The average value of n for a satisfactory ethylene oxide content can vary within the specified range in accordance with the equivalent weight as determined by the use of hydrogen, sodium, or potassium for M and the alkyl or alkylaryl selected for R. For example, values of n from about 4 to about 10 with an average value of about 7 for the phosphate acid diester are typical production batches of the phosphate acid diester which are useful in accordance with this invention.

The cure rate of a composite propellant was evaluated by adding to a propellant composition of Table I as follows:

TABLE I

| Ingredient | Weight Percentage |
|---|---|
| Hydroxy terminated polybutadiene (R45M*) (binder) | 58.7% |
| Isophorone diisocyanate (crosslinker) | 3.9 |
| Isodecyl pelargonate (plasticizer) | 6.7 |

TABLE I-continued

| Ingredient | Weight Percentage |
|---|---|
| Ferrocene derivative** (burning rate catalyst) (e.g. Catocene) | 30.7 |

*Arco Chemical Company
**Catocene - Arapahoe Chemicals

A 0.3%–2.5% additive of phosphate acid diester based on binder only, provided extended pot life; however, in the presence of ultra fine ammonium perchlorate (UFAP) a 0.5% additive extended pot life very effectively without inhibiting the final cure.

BRIEF DESCRIPTION OF THE DRAWING

FIGS. 3–6 depict the cure inhibition by a phosphate acid diester in the presence of UFAP.

DESCRIPTION OF THE PREFERRED EMBODIMENT

Figure 1:
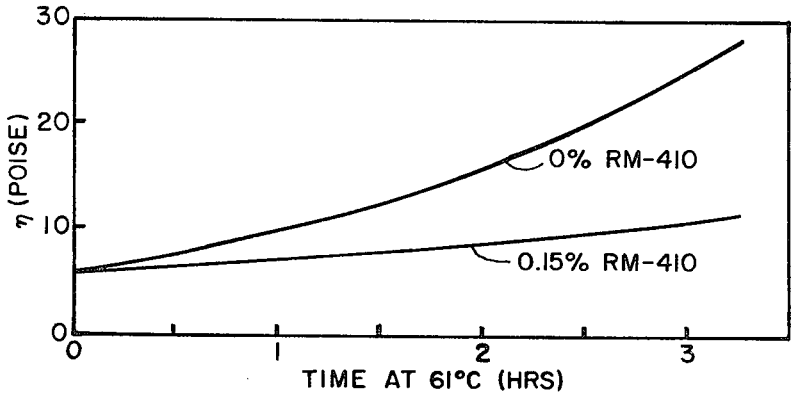
FIGS. 1–6 are curing rate curves which depict in FIGS. 1 and 2 the effects of employing a phosphate acid diester in combination with a binder composition.

A phosphate acid diester of this invention has the formula illustrated as follows:

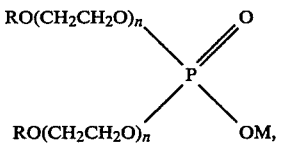

wherein R equals alkyl or alkylaryl radical, M equals H or alkali metal (Na or K), and n equals average number of moles ethylene oxide reacted with one mole hydrophobe to increase the water solubility of the phosphate acid diester. The phosphate acid diester is employed in a hydroxy terminated polybutadiene propellant that employs ferrocene or a ferrocene derivative as burning rate catalyst. The diester extends pot life without inhibiting the final cure.

The effectiveness of the phosphate acid diester of this invention was measured by testing with a propellant composition with and without UFAP. Table II sets forth the basic propellant composition which was employed.

TABLE II

| Ingredient | Weight Percent | Weight Percent Range |
|---|---|---|
| Hydroxy terminated polybutadiene (binder) | 58.7 | 52–60 |
| Isophorone diisocyanate (curing & crosslinking agent) | 3.9 | 2–5 |
| Isodecyl polargonate (plasticizer) | 6.7 | 5–7 |
| Ferrocene derivative (burning rate catalyst) | 30.7 | 28–41 |

When testing with UFAP, a portion of the binder formulation representing a ratio of 80%–90% binder is employed with 10% to 20% UFAP and the additive in an amount from about 0.3% to about 2.5% by weight of the composition as combined in the test formulation.

Table III presents typical properties of a commercially available phosphate acid diester (GAFAC RM-410) in accordance with this invention.

TABLE III

| Typical Properties | Typical Properties Value |
|---|---|
| Appearance (25° C.) | Clear slightly hazy yellow liquid |
| Activity | Essentially 100% |
| Moisture | 0.57 max |
| Specific Gravity (25° C.) | 1.06 |
| Lb/Gal (approx) | 8.8 |
| Pour Point (ASTM) | 19° C. |
| pH (10% dispersion) | 2.0–3.0 |
| Acid Number (mg KOH/g product) | |
| 1st Infection Point (pH 5–5.5) | 51–64 |
| 2nd Infection Point (pH 9–9.5) | 95–110 |
| Flash Point | 230° C. |
| Solubility* | |
| Nonpolar Solvents | |
| Mineral Oil | S |
| Kerosene | S |
| Stoddard Solvent | S |
| Cottonseed Oil | S |
| Xylene | S |
| Polar Solvents | |
| GAFCOL EB** | S |
| Perchloroethylene | S |
| Ethanol | S |
| Water | D |

*5% Surfactant, 95% solvent (by weight)
**GAF brand of ethylene glycol monobutyl ether
S = soluble (clear solution)
D = dispersion or self emulsifying Certain ferrocene compounds, e.g. n-butyl ferrocene, have been found to be more subject to migration in a propellant composition; hence, the need for ferrocene derivatives which show less tendency to migrate was established. A representative structure of a ferrocene derivative (shown below) which was effective as a burning rate catalyst, does not crystallize on cooling but sets to a glass at low temperature, and shows less tendency to migrate, did have a tendency to decrease pot life when used in hydroxy terminated polybutadiene propellants employing a diisocyanate cure and with or without ultrafine ammonium perchlorate. However, the phosphate acid diester of this invention was particularly effective in extending the pot life of propellants which employed the improved ferrocene derivative as catalyst.

FERROCENE DERIVATIVE

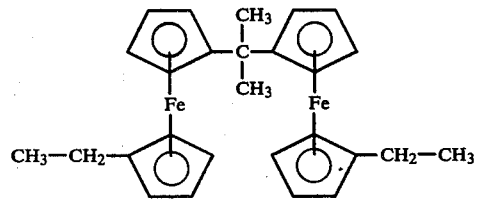

The ferrocene derivative illustrated above is a viscous, dark orange liquid, specifically designed for use as a combustion catalyst for solid propellants (ammonium perchlorate, aluminum powder composition). A brand name product, Catocene, Catalog No 520, is available from Arapahoe Chemicals. This product was tested in accordance with this invention and was found to meet the description and criteria for use, thereby having a pot life which could be lengthened by the phosphate acid diester of this invention without having the final cure of the propellant inhibited.

Figure 2:
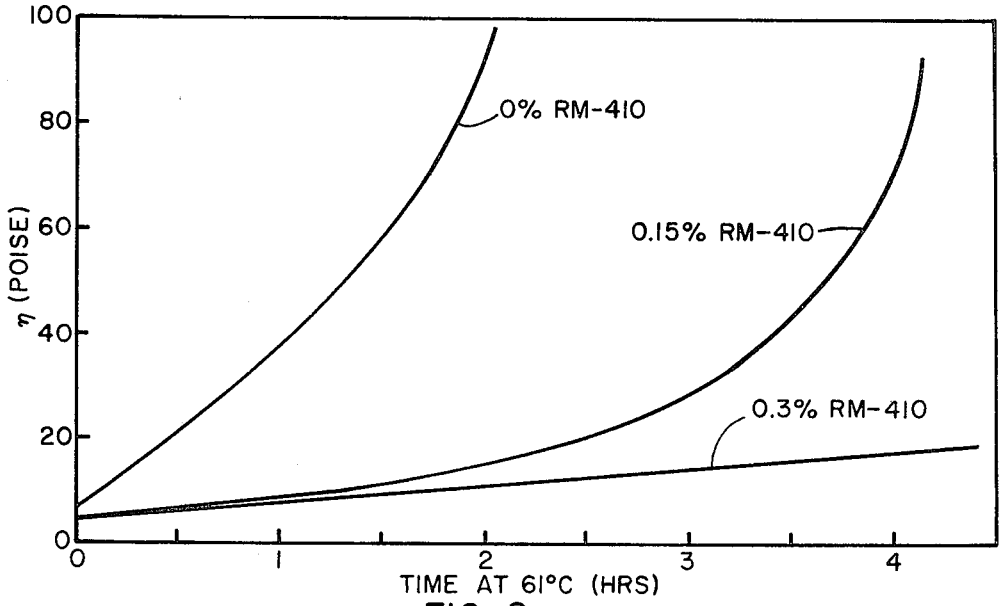
Figure 3:
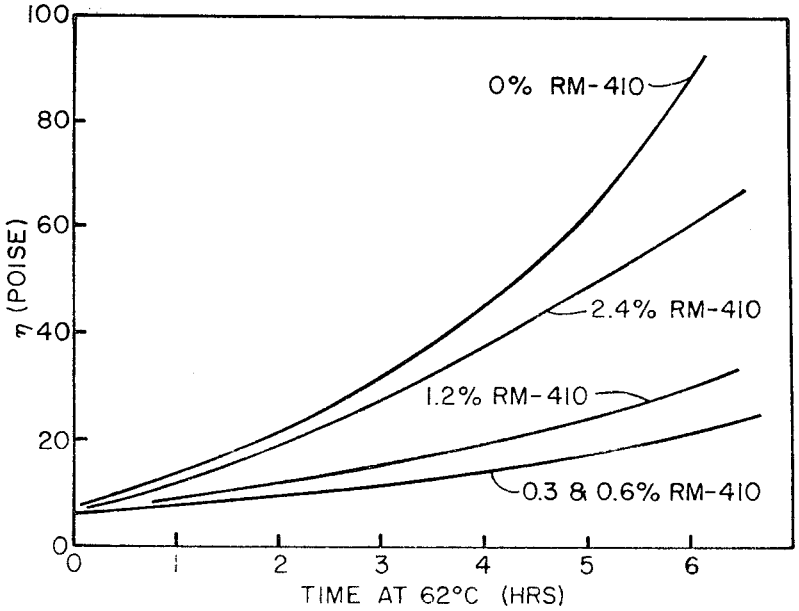
Figure 4:
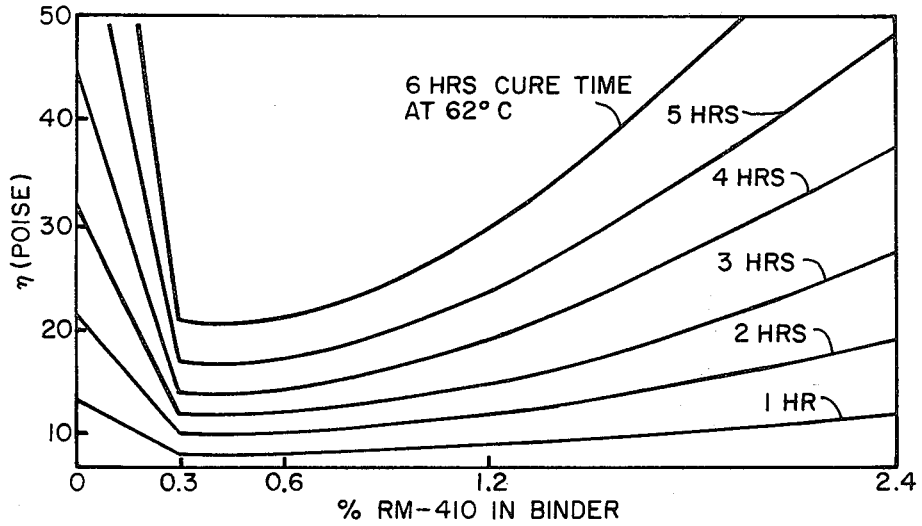

FIG. 1 of the drawing depicts the effects of the phosphate acid diester of this invention on cure rates of a propellant binder employing a ferrocene derivative, Catocene which contains an antioxidant. FIG. 2 shows the effect of phosphate acid diester on cure rates of propellant binder containing an older lot of Catocene without an antioxidant. FIG. 3 shows the effects of the phosphate acid diester concentration on cure rates of propellant binder with 10% UFAP.

The older lot of Catocene required more phosphate acid diester to inhibit the cure than did the newer lot. FIG. 2 also demonstrates the latency of the catalyst activity.

Figure 5:
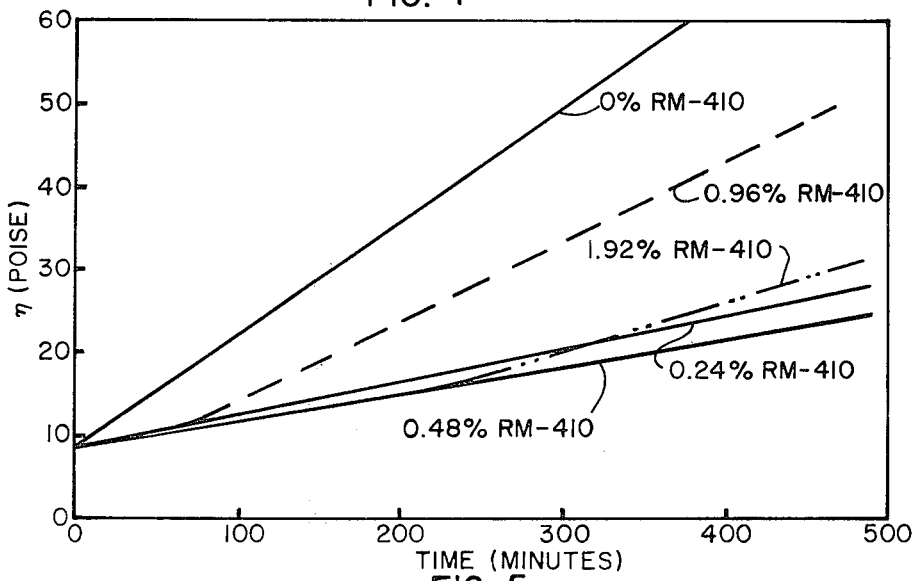
Figure 6:
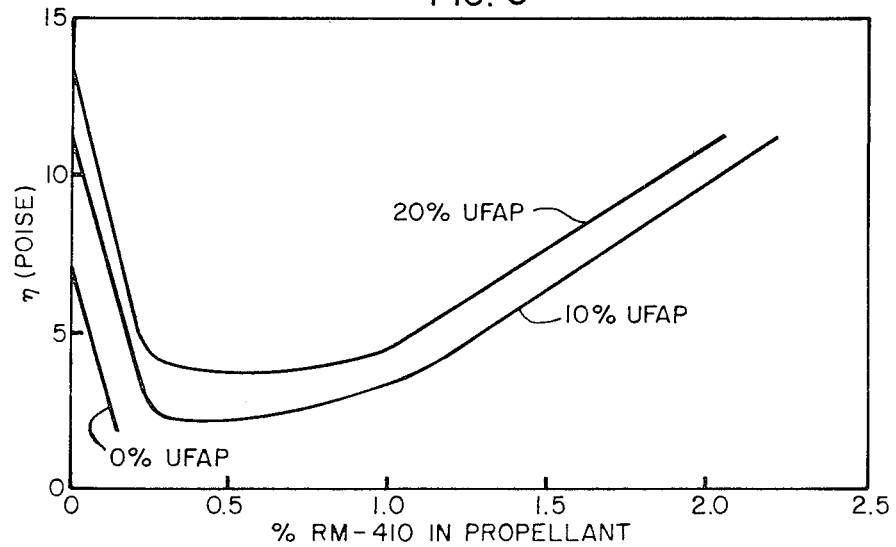

FIGS. 3–6 demonstrate the cure inhibition of the phosphate acid diester in the presence of UFAP. For example, further reference to the drawing shows in FIG. 4 the cure rates of propellants employing 10% UFAP and the phosphate diester in variable amounts from 0.3% to 2.4%. FIG. 5 depicts the viscosity of 20% UFAP propellant at various times when employing phosphate diester (RM-410 in an amount 0.24%, 0.48%, 0.96% and 1.92%, as compared to 0% RM-410 in control. FIG. 6 is a plotting of % phosphate diester in propellant for 0% UFAP, 10% UFAP, and 20% UFAP to illustrate change in propellant cure rate.

I claim:

1. A composite propellant composition containing a phosphate acid diester which functions as a cure-rate inhibitor to thereby increase the pot life of said composite propellant containing ferrocene or ferrocene derivatives, said composite propellant composition comprising:

(i) hydroxyl terminated polybutadiene binder in an amount from about 52 to about 60 weight percent;
(ii) isophorone diisocyanate curing and crosslinking agent in an amount from about 2 to about 5 weight percent;
(iii) isodecyl pelargonate plasticizer in an amount from about 5 to about 7 weight percent;
(iv) a burning rate catalyst selected.from a ferrocene or a ferrocene derivative in an amount from about 28 to about 41 weight percent; and
(v) an additive of a phosphate acid diester which functions as a cure-rate inhibitor in an amount from about 0.3 to about 2.5 weight percent, said phosphate acid diester having the formula:

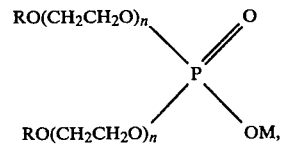

wherein n equals the average number from about 1 to about 10 moles ethylene oxide reacted with one mole hydrophobe, R equals alkyl or alkylaryl radical, and M equals hydrogen or an alkali metal selected from sodium and potassium.

2. The composite propellant composition of claim 1 wherein said phosphate acid diester has an average value for said n of about 7 and wherein said burning rate catalyst selected is the ferrocene derivative of the formula:

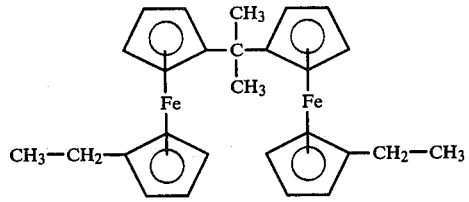

3. The composite propellant composition of claim 2 which additionally contains ultrafine ammonium perchlorate oxidizer in an amount from about 10 to about 20 weight percent of said composite propellant composition.

4. The composite propellant composition of claim 3 wherein said ammonium perchlorate is present in an amount of about 20 weight percent of said composite propellant composition and wherein said phosphate acid diester is present in an amount of about 0.5 weight percent of said composite propellant composition.

* * * * *